US006155555A

United States Patent [19]

Maass

[11] Patent Number: 6,155,555

[45] Date of Patent: Dec. 5, 2000

[54] DEVICE FOR SUPPLYING AIR TO ELECTROMAGNETIC LINEARLY DRIVEN LIFTERS AIR CONSUMERS OF A SHEET-PROCESSING MACHINE

[75] Inventor: Jürgen Maass, Wiesloch, Germany

[73] Assignee: Heidelberger Druckmaschinen Aktiengesellschaft, Heidelberg, Germany

[21] Appl. No.: 09/217,858

[22] Filed: Dec. 21, 1998

[30] Foreign Application Priority Data

Dec. 20, 1997 [DE] Germany ..... 197 57 164

[51] Int. Cl.[7] ..... B65H 3/14

[52] U.S. Cl. ..... 271/98; 271/11; 271/107; 271/108; 414/676; 414/752

[58] Field of Search ..... 271/11, 12, 98, 271/107, 108; 414/793, 676, 752

[56] References Cited

U.S. PATENT DOCUMENTS

| | | | |
|---|---|---|---|
| 4,186,918 | 2/1980 | Ficker et al. | 271/232 |
| 4,482,145 | 11/1984 | Feldkamper et al. | 271/95 |
| 4,483,527 | 11/1984 | Hashimoto et al. | 271/5 |
| 4,564,188 | 1/1986 | McNair | 271/103 |
| 4,640,503 | 2/1987 | Naumann | 271/103 |
| 4,984,960 | 1/1991 | Szarka | 414/752 |
| 5,074,538 | 12/1991 | Naumann | 271/11 |
| 5,238,355 | 8/1993 | Bodrini et al. | 414/797 |
| 5,426,921 | 6/1995 | Beckmann | 53/566 |
| 5,542,658 | 8/1996 | Wirz et al. | 271/107 |
| 5,622,362 | 4/1997 | Shiiki et al. | 271/91 |
| 5,676,364 | 10/1997 | Shiiki et al. | 271/91 |
| 5,863,037 | 1/1999 | Jost | 271/90 |

FOREIGN PATENT DOCUMENTS

| | | | |
|---|---|---|---|
| 2687652 | 8/1993 | France | 271/11 |
| 2226548 | 4/1990 | United Kingdom | 271/107 |

*Primary Examiner*—Donald P. Walsh
*Assistant Examiner*—David A Jones
*Attorney, Agent, or Firm*—Herbert L. Lerner; Laurence A. Greenberg; Werner H. Stemer

[57] ABSTRACT

Device for supplying air to at least one electromegnetic linearly driven air consumer in a sheet-processing machine, includes a fixedly disposed air supply bar, the air consumer being arranged so as to be movable along the air supply bar.

11 Claims, 3 Drawing Sheets

DEVICE FOR SUPPLYING AIR TO ELECTROMAGNETIC LINEARLY DRIVEN LIFTERS AIR CONSUMERS OF A SHEET-PROCESSING MACHINE

BACKGROUND OF THE INVENTION

Field of the Invention

The invention relates to a device for supplying air to linearly driven lifters and/or conveyors of a sheet-processing machine.

It has been known for a long time that, by suitable lifters and/or conveyors, for example suckers, sheets can be separated from a sheet pile by being lifted, and can be suitably transported in the direction of a sheet-processing machine, such as a printing press, for example. An air supply, in particular a suction air supply to the lifters and/or conveyors, is reliably provided by hoses which are connected to a suction air source and, in turn, connect the latter to a respective lifter and/or conveyor.

The published German Patent Document DE 36 D6 178 C1 has disclosed, for example, a device for separating and transporting a sheet from a sheet pile, the device being provided with a linear drive in the form of a working cylinder. A hose to which vacuum can be applied supplies a suction head with suction air from a non-illustrated suction air source.

Supplying moving suction air consumers by flexible hoses has the disadvantage that the continuous reciprocating movement loads the hoses severely and, in particular, in the case of high bending loading, leads to a rupturing of the supply hose.

SUMMARY OF THE INVENTION

It is accordingly an object of the invention, therefore, to provide linearly driven suction air or blown air consumers with a device for supplying the air from linearly driven lifters and conveyors of a sheet-processing machine which either have no supply hoses at all or have supply hoses which are stationary.

With the foregoing and other objects in view, there is provided, in accordance with the invention, a device for supplying air to at least one linearly driven lifter and/or conveyor in a sheet-processing machine, comprising a fixedly disposed air supply bar, the lifter and/or conveyor being arranged so as to be movable along the air supply bar.

In accordance with another feature of the invention, the air supply bar has at least one opening corresponding to an opening formed in the lifter and/or conveyor.

In accordance with a further feature of the invention, the last-mentioned opening is formed in a carriage whereon the lifter and/or conveyor are arranged, the last-mentioned opening having a length extending in the sheet transport direction which is greater than the length of the one opening in the supply bar.

In accordance with an added feature of the invention, the air-supplying device includes a switchable valve provided for the one opening in the supply bar.

In accordance with an additional feature of the invention, the air-supplying device includes a switchable valve for applying suction air to the at least one opening in the supply bar.

In accordance with yet another feature of the invention, the air-supplying device includes an ejector disposed in the carriage between the last-mentioned opening formed in the carriage and the lifter and/or conveyor, so that blown air provided at the at least one opening in the supply bar is convertible into suction air.

In accordance with yet a further feature of the invention, the air supply bar is of such length that it projects beyond a rear part of a sheet pile.

In accordance with yet an added feature of the invention, the air-supplying device includes, in addition to the carriage, which is reciprocatingly displaceable, a carriage fixable in position and carrying auxiliary elements.

In accordance with yet an additional feature of the invention, the air-supplying device includes an additional opening formed in a rear part of the supply bar for therethrough supplying the auxiliary elements with blown air via an opening and a bore formed in the carriage.

In accordance with still another feature of the invention, the supply to the lifter and/or conveyor is provided separately from the supply to the auxiliary elements.

In accordance with a concomitant feature of the invention, the supply to the lifter and/or conveyor and to the auxiliary elements is provided jointly from one blown air source.

An advantage of the invention is, in particular, the reduction in moving masses. Furthermore, for example, in the case of using the device on a feeder in a sheet-processing machine, for example, a printing press, access to the sheet pile is improved, because it is no longer impeded by the supply hoses to the moving suction air and blown air users or consumers.

In an advantageous refinement, a stationary suction bar is provided and, via at least one opening, supplies suction air to a carriage which is displaceable along the bar.

In a second exemplary embodiment, provision is made, in order to reduce leakage problems, for example, the aspiration of dust particles, for subjecting the supply bar to blown air, so that the carriage receives blown air via the opening in the supply bar and this blown air provides suction air to the consumer by a suitable ejector device.

Auxiliary elements provided for separating or singling sheets, such as loosening and carrier-air blowers, for example, may advantageously be arranged on a carriage which is movable in the sheet transport direction, in order to set the format, and which also receives blown air via the supply bar.

Switching valves which are provided activate the openings for the transport carriage and the carriage for the auxiliary elements, respectively, namely, those openings which correspond to the respective sheet format.

If, as provided in the second exemplary embodiment, only blown air is used, the auxiliary elements may be supplied via the openings which are provided for the transport carriage.

Other features which are considered as characteristic for the invention are set forth in the appended claims.

Although the invention is illustrated and described herein as embodied in a device for supplying air to linearly driven lifters and/or conveyors in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
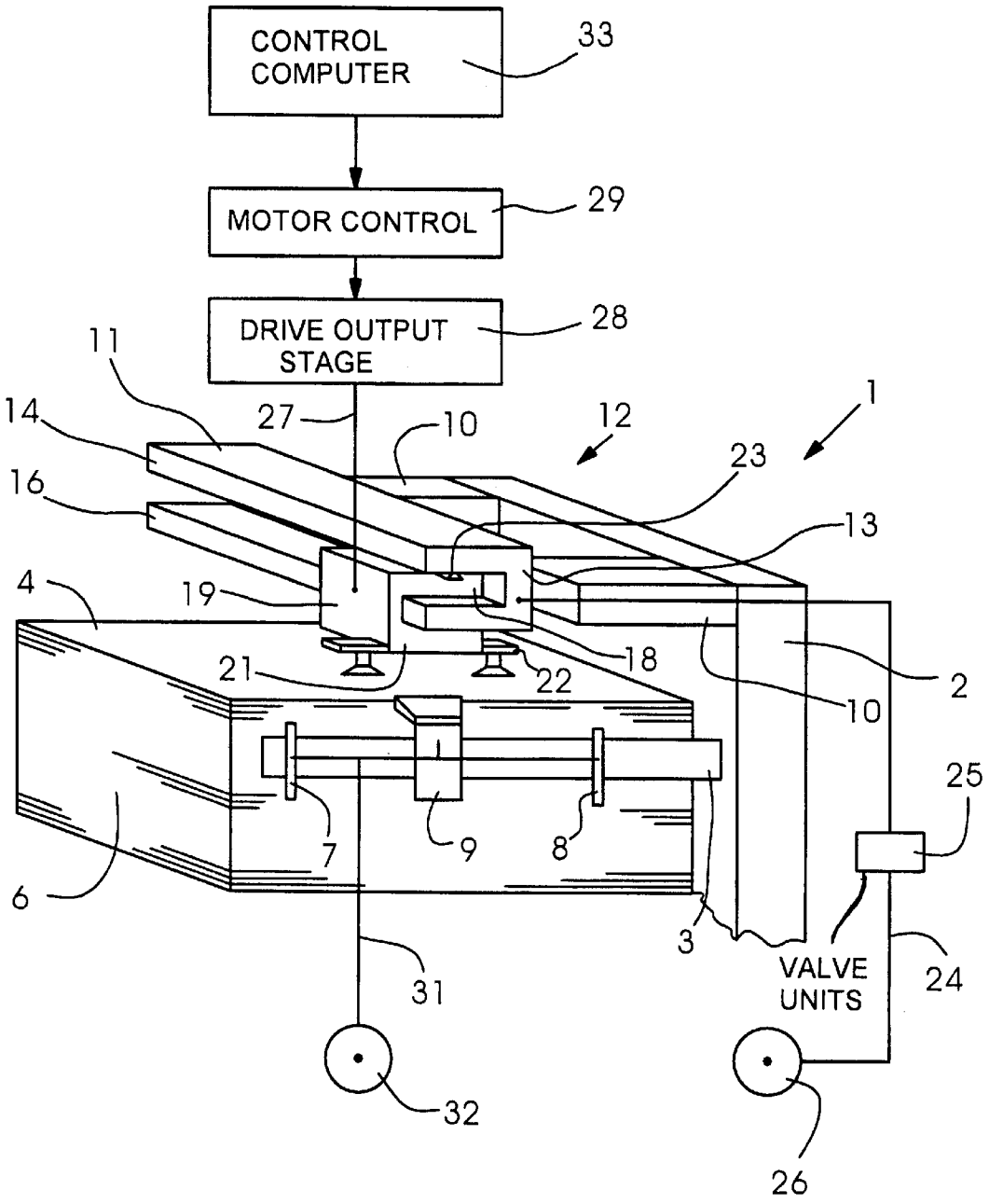
FIG. 1 is a front, side and top perspective view, partly diagrammatic and schematic, of a sheet feeder incorporating the device according to the invention.
Figure 2:
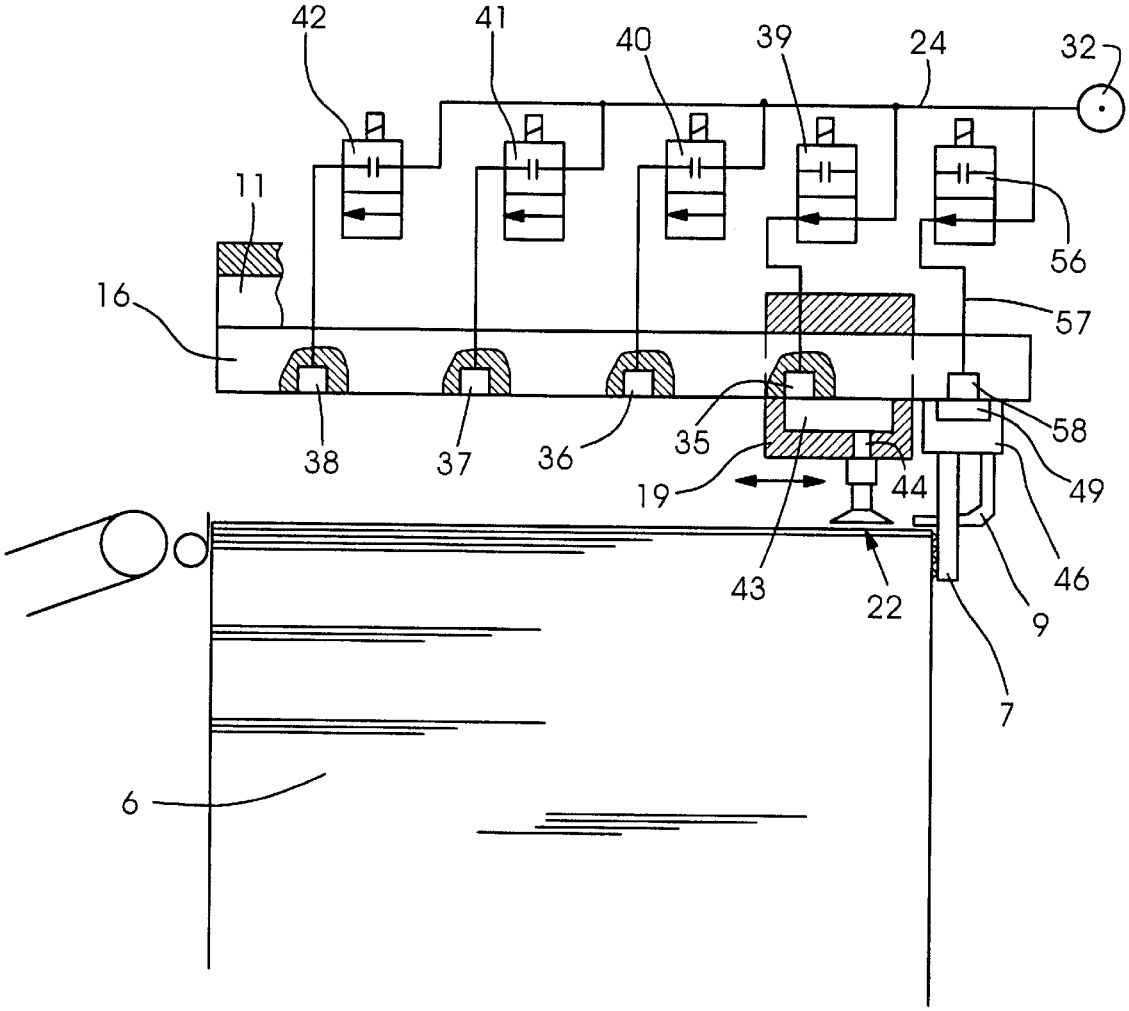
FIG. 2 is a diagrammatic and schematic front elevational view, partly in section, of a detailed first exemplary embodiment of the air supplying device according to the invention on a feeder for a sheet-processing machine.

Referring now to the drawings and, first, particularly to FIG. 1 thereof, there is shown therein a sheet feeder 1 for a sheet-processing machine, in particular a printing press, having a frame 2, to which a first crossmember 3 is fastened in order to hold auxiliary elements which aid the separation or singling of a sheet 4 from a sheet pile 6. These auxiliary elements are, for example, loosening blowers 7 and 8 and a sensing foot 9, formed as a carrier-air blower, for blowing underneath a lifted paper sheet and for determining the exact pile height and controlling the tracking of the pile. As illustrated in FIG. 2, the auxiliary elements may also be arranged on a carriage 46 of their own, which is fixable and lockable, respectively, in size or format-dependent positions.

As further shown in FIG. 1, above the sheet pile 6, a second crossmember or traverse 10 disposed parallel to the sheet pile 6 is fastened to the frame 2 and extends approximately as far as the center of the sheet pile 6 and, at an end of the second crossmember 10, the latter carries an electromagnetic linear drive 12. The linear drive 10 extends from one end of the sheet pile 6, in the direction of the printing press, over a length which corresponds at least to the sheet format length to be processed. The linear drive 12 primarily includes a rail-like guide 11 and a carriage 19 displaceable in the guide 11. The guide 11 is a horizontally disposed U-profile fastened via a base surface 13 thereof to the crossmember 10 and, in the legs 14 and 16 thereof, has permanent magnets which are provided in a row in the sheet transport direction with an alternating pole arrangement. In this regard, a north pole of a permanent magnet in the leg 14 is located at a spaced distance opposite a south pole in the leg 16 and vice versa, while north and south poles alternate alongside one another within a respective leg 14, 16. A magnetic field is generated between the legs 14 and 16 by the permanent magnets. Arranged between the legs 14 and 16, in the magnetic field, is the carriage 19, that has a coil fastened to a leg 18 of a second likewise horizontally disposed U-profile. A second leg 21 of the U-profile carries a combined lifting/pull sucker unit 22. The leg 18 of the U-profile is mounted between the legs 14 and 16 so that it is displaceable in or counter to the sheet transport direction, and is secured against falling out sidewise by a dovetail guide 23. The coil is controlled, via a control line 27, by a drive output stage 28, which is connected to a motor control 29. The motor control 29 receives control commands from a control computer 33. The latter also controls, inter alia, the blown air and suction air supply for valve units 25 for the sheet feeder 1.

The leg 16 is connected, by the valve units 25, which are switchable, and via a feed line 24, to a suction air or blown air supply source 26. The loosening blowers 7 and 8 and an integrated blower on the sensing foot 9 are connected via a supply line 31 to a blown air source 32.

As shown particularly in FIG. 2, the leg 16 of the linear guide 11 has at least one opening, but preferably a number of openings 35, 36, 37 and 38 distributed over the length thereof. Each of the openings 35 to 38 is connected to a switchable valve 39 to 42. The openings 35 to 38 are formed in an underside of the leg 16, so that they, respectively, can be brought into alignment with an opening 43 formed in the leg 21 of the carriage 19. Depending upon the format or size of the sheet to be processed, the opening 43 is in the region of the opening 35 in the case of a large sheet format, and down as far as the opening 38, in the case of a small sheet format being processed. The opening 43 has the shape of a slot which extends in the transport direction and has a length that is a measure of the maximum transport travel (for example, shingle or overlap length).

In this manner, the lifting/pull sucker unit 22 is continuously supplied with suction air from the opening 43 via a bore 44.

When large sheet formats, for example, are processed, the valve 39 is switched to open, while the valves 40 to 42 are closed. When the auxiliary elements 7, 8 and 9 are arranged on the carriage 46 so that they can be adjusted in the transport direction, the supply of blown air to the auxiliary elements 7 to 9 is provided by a bore 47 formed in the carriage 46. The carriage 46 is constructed in a manner corresponding to the carriage 19 and has on the upper leg 48 thereof an opening 49, in which the bore 47 terminates. The bore 47 can be brought into alignment with an opening or bore 50 formed in the linear guide 11. A number of the openings 50 are arranged in a format-dependent manner. The opening 49 is a slot which extends in the transport direction and which permits fine adjustment in the area wherein the openings 49 and 50 align. Switchable valves 51 assigned to the openings 50 release the blown air supply to those openings 50 which are to be activated, and close the openings 50 which are not to be activated, respectively.

Figure 3:
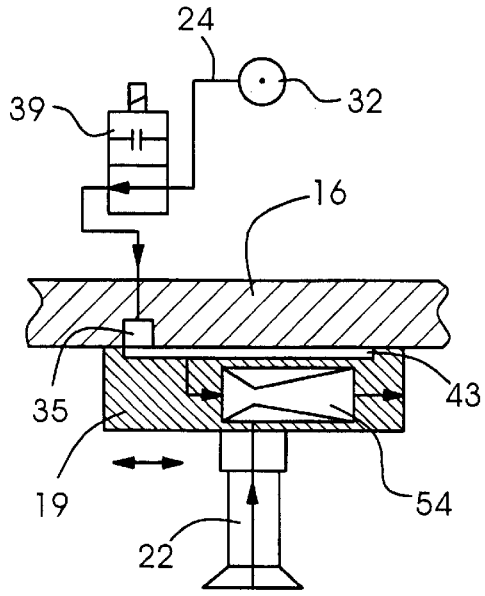
FIG. 3 is a fragmentary view of FIG. 2 showing a second exemplary embodiment of the device according to the invention.
Figure 4:
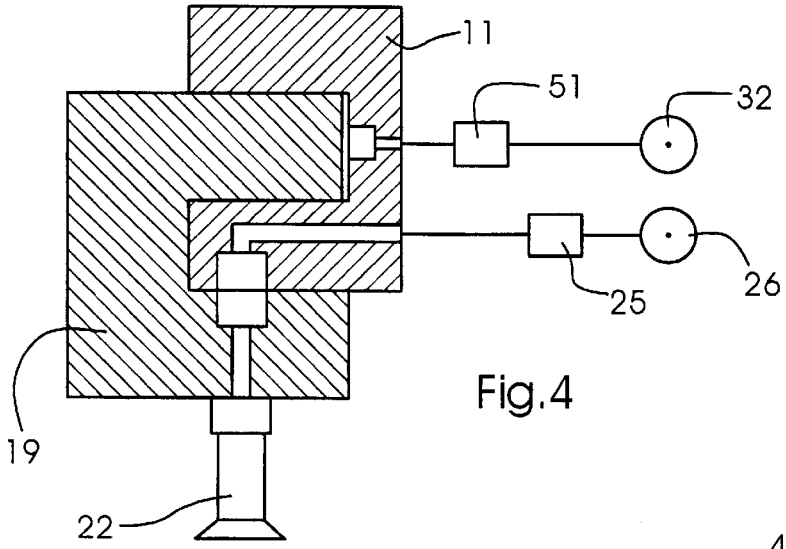
FIG. 4 is a fragmentary view similar to that of FIG. 3, showing in section a linear guide in the vicinity of a reciprocating carriage.
Figure 5:
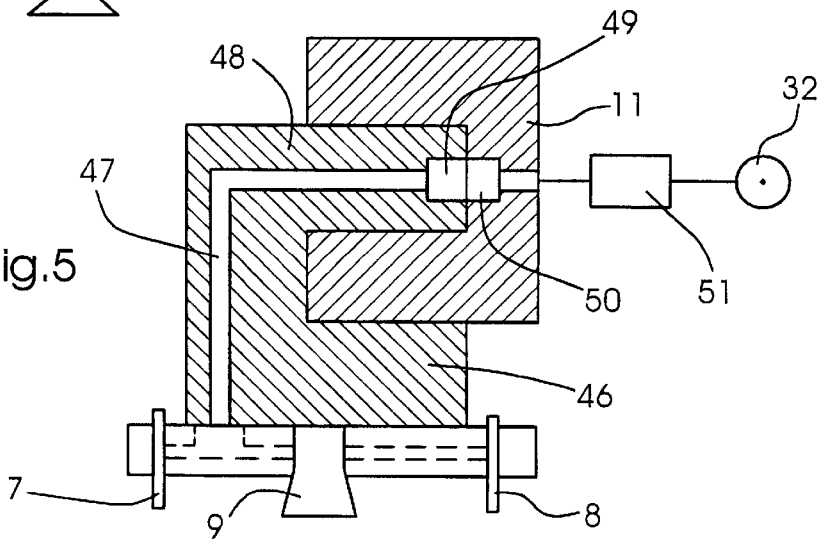
FIG. 5 is a fragmentary view similar to that of FIGS. 3 and 4, showing in section a linear guide in the vicinity of a carriage provided for auxiliary elements and fixable in position.

In the case of a second exemplary embodiment, as shown in FIG. 3, provision is made for supplying all consumers with blown air. In this regard, in order to produce suction air for the lifting/pull sucker unit 22, an ejector 54 is arranged in the carriage 19. In the case of the second exemplary embodiment, the supply of blown air to the auxiliary elements 7 to 9 is provided via the supply line 24, connected to the blown air source 32 and the valves 37 to 39, as shown in FIG. 2, or to an additional valve 56 if the valve 39 is needed for the blown air supply to the carriage 19 (large sheet format).

The additional valve 56 switches a supply line 57 to an opening 58, that is located in an area of the guide or leg 16 projecting beyond one end of the sheet pile 6.

I claim:

1. A device for supplying air to at least one linearly driven air consumer in a sheet-processing machine, comprising:

an electromagnetic linear drive including a fixedly disposed rail-like guide and a carriage moveable along said guide, said guide forming an air supply bar having at least one opening; and at least one air consumer selected from the group consisting of a suction air consumer and a blast air consumer disposed on said carriage, said air consumer formed with an opening for communicating with said opening of said air supply bar.

2. The air-supplying device according to claim 1, wherein said carriage is formed with an opening communicating with said opening of said air consumer, said opening of said carriage having a length extending in the sheet transport direction which is greater than the length of said at least one opening in said supply bar.

3. The air-supplying device according to claim 2, including a switchable valve provided for said at least one opening in the supply bar.

4. The air-supplying device according to claim 1, including a switchable valve for applying suction air to said at least one opening in said supply bar.

5. The air-supplying device according to claim 2, including an ejector disposed in said carriage between said opening formed in said carriage and said air consumer, so that blown air provided at said at least one opening in said supply bar is convertible into suction air.

6. The air-supplying device according to claim 1, wherein said air supply bar is of such length that it projects beyond a rear part of a sheet pile.

7. The air-supplying device according to claim 6, including an additional carriage fixable in position and carrying auxiliary elements.

8. The air-supplying device according to claim 7, including an additional opening formed in a rear part of said supply bar for therethrough supplying said auxiliary elements with blown air via an opening and a bore formed in said additional carriage.

9. The air-supplying device according to claim 7, wherein the supply to the air consumer is provided separately from the supply to said auxiliary elements.

10. The air-supplying device according to claim 8, wherein the supply to the air consumer and to said auxiliary elements is provided jointly from one blown air source.

11. The air-supplying device according to claim 1, wherein said air consumer is a sucker.

* * * * *